US006790107B2

(12) United States Patent
Tanaka

(10) Patent No.: US 6,790,107 B2
(45) Date of Patent: Sep. 14, 2004

(54) PERSONAL WATERCRAFT

(75) Inventor: Yoshinobu Tanaka, Hyogo (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 29 days.

(21) Appl. No.: 10/339,127

(22) Filed: Jan. 8, 2003

(65) Prior Publication Data

US 2003/0129885 A1 Jul. 10, 2003

(30) Foreign Application Priority Data

Jan. 10, 2002 (JP) ..... 2002-003280

(51) Int. Cl.[7] ..... B63H 21/22
(52) U.S. Cl. ..... 440/1; 440/87
(58) Field of Search ..... 440/1, 2, 88 C, 440/88 D

(56) References Cited

U.S. PATENT DOCUMENTS 4,938,721 A * 7/1990 Koike ..... 440/2
5,769,055 A * 6/1998 Motose et al. ..... 123/478
6,250,976 B1 * 6/2001 Ozawa ..... 440/1
6,478,644 B1 * 11/2002 Ozawa et al. ..... 440/89 R
6,517,394 B2 * 2/2003 Ozawa ..... 440/1

* cited by examiner

*Primary Examiner*—Ed Swinehart
(74) *Attorney, Agent, or Firm*—Kolisch Hartwell, P.C.

(57) ABSTRACT

Disclosed is a jet-propulsion personal watercraft utilizing an open-loop cooling type engine, capable of judging that sufficient warming up of the engine has been achieved, and of executing control so as not to increase an engine speed of the engine before completion of sufficient warming up. The personal watercraft is adapted to limit the engine speed to be lower than a predetermined engine speed when a temperature of cooling water of the engine is lower than a predetermined temperature.

17 Claims, 6 Drawing Sheets

PERSONAL WATERCRAFT

BACKGROUND OF THE INVENTION

1. Field of the Invention

The present invention relates to a jet-propulsion personal watercraft (PWC) equipped with an open-loop cooling type engine, and more particularly to control for warming up of the engine.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

Some types of personal watercraft employ an engine with an open-loop cooling system. In the open-loop cooling system, water such as sea water is taken in from outside the watercraft, pressurized by the water jet pump, and used as cooling water for cooling the engine. In such an engine cooling system, advantageously, the amount of cooling water supplied to the engine by the water jet pump is small at a low engine speed because the water jet pump generates a low supplying pressure for the cooling water. Thus, warming up of the engine is easy. On the other hand, the amount of cooling water is large at a high engine speed because the water jet pump generates a high pressure, and thereby sufficient cooling effect is gained.

However, in the above engine cooling system adapted to take in the water from outside, the engine is sometimes excessively cooled when the temperature of the water is low. In particular, when starting the engine and for a time thereafter, a clearance between a cylinder and a corresponding piston of the engine is small, and in this state, if the engine is operated at a high speed, the engine is subjected to a large frictional load. In such situation, in general, "warming up" is necessary.

In the meantime, an operator of the watercraft has difficulties in judging that sufficient warming up of the engine has been achieved, and sometimes opens a throttle of the engine to increase the engine speed before the completion of sufficient warming up.

SUMMARY OF THE INVENTION

The present invention addresses the above-described conditions, and an object of the present invention is to provide a jet-propulsion personal watercraft that employs an open-loop cooling type engine and is capable of executing a control so as not to increase an engine speed before sufficient warming up of the engine has been achieved, irrespective of an operator's will.

A personal watercraft according to the present invention which is propelled by a water jet pump driven by an open-loop cooling type engine having an open-loop cooling system including a cooling water passage which takes in water from outside the watercraft and uses the water as cooling water for the cooling system. The personal watercraft comprises a control unit adapted to limit an engine speed of the engine to be lower than a predetermined engine speed when a temperature of the cooling water is lower than a first predetermined temperature.

In accordance with the above invention, particularly, in the jet-propulsion personal watercraft equipped with the open-loop cooling type engine, the control is executed so as not to increase the engine speed when the cooling water temperature of the engine is low. This assures the completion of sufficient warming up. The operator is able to know that sufficient warming up of the engine is completed when the engine speed can be increased by, such as trying to open a throttle of the engine. However, the operator cannot increase the engine speed before the completion of sufficient warming up. This prevents the engine under excessively cooled condition from being subjected to a large frictional load.

In the present invention, a time point of the completion of sufficient warming up is defined as when the temperature of the cooling water reaches the first predetermined temperature. To judge whether or not the temperature of the cooling water reaches the first predetermined temperature, the following parameters may be used solely or in combination:

(a) a temperature of the cooling water (direct use), (b) a temperature of the engine (e.g., temperature of a side face of a cylinder or a surface of a cylinder head), and (c) a lapsed time from when the engine starts until sufficient warming up is completed, which is measured in advance.

(a) When the cooling water temperature is directly utilized, a temperature detecting means may be attached to any suitable position in the cooling water passage, preferably, in an exit of the cooling water from the engine where a warming up state of the engine is best reflected. By the cooling water temperature detected by the temperature detecting means reaching the first predetermined temperature, it is determined that sufficient warming up of the engine is completed.

(b) Alternatively, when the temperature of the engine is utilized, the temperature detecting means may be attached to any suitable position in the engine, preferably, on an outer surface of the engine cylinder (side face of a cylinder or a cylinder head) which is susceptible to a frictional load in the engine while the engine is excessively cooled. By the temperature of the engine detected by the temperature detecting means reaching a predetermined temperature (corresponding to the cooling water temperature being almost equal to the first predetermined temperature), it is determined that sufficient warming up of the engine is completed. The temperature of the engine for judging the completion of sufficient warming up is easily obtained in such a manner that the engine temperature corresponding to the cooling water temperature at the completion of sufficient warming up is measured in advance and pre-stored in a memory of an ECU (Electronic Control Unit) or the like generally built in the personal watercraft. As for the four-cycle engines, a temperature of lubricating oil may be used instead of the temperature of the cooling water.

(c) The lapsed time from when the engine starts until sufficient warming up is completed is measured in advance, and by clocking the measured time from starting of the engine, it is determined that sufficient warming up is completed. This eliminates a need for temperature measurement during control.

Before completion of sufficient warming up, the control is executed so as to increase the engine speed up to and not to exceed, for example, approximately 3000 rpm. Alternatively, the control may be executed so that the engine speed stays at an idling speed.

At the completion of sufficient warming up, the above limitation of the engine speed may be completely released, or otherwise an upper limit of the engine speed (i.e., the predetermined engine speed) may be increased gradually (e.g., stepwise) according to progress of the warming up.

Further, the limitation of the engine speed may be performed by adjusting fuel injection amount, fuel injection timing and/or ignition timing, or by adjusting a throttle of the engine.

Also, when the cooling water temperature of the engine is higher than a second predetermined temperature which is higher than the first predetermined temperature, the control may be executed to limit the engine speed to be less than the predetermined engine speed.

When the above invention is applied to the personal watercraft which has the engine cooling system using water pressurized by the water jet pump as the cooling water and is susceptible to temperature of the water outside the watercraft, greater effects are obtained.

The above and further objects and features of the invention will more fully be apparent from the following detailed description with accompanying drawings.

DETAILED DESCRIPTION OF THE PREFERRED EMBODIMENTS

Hereinafter, a preferred embodiment of the present invention will be described with reference to the accompanying drawings.

Figure 1:
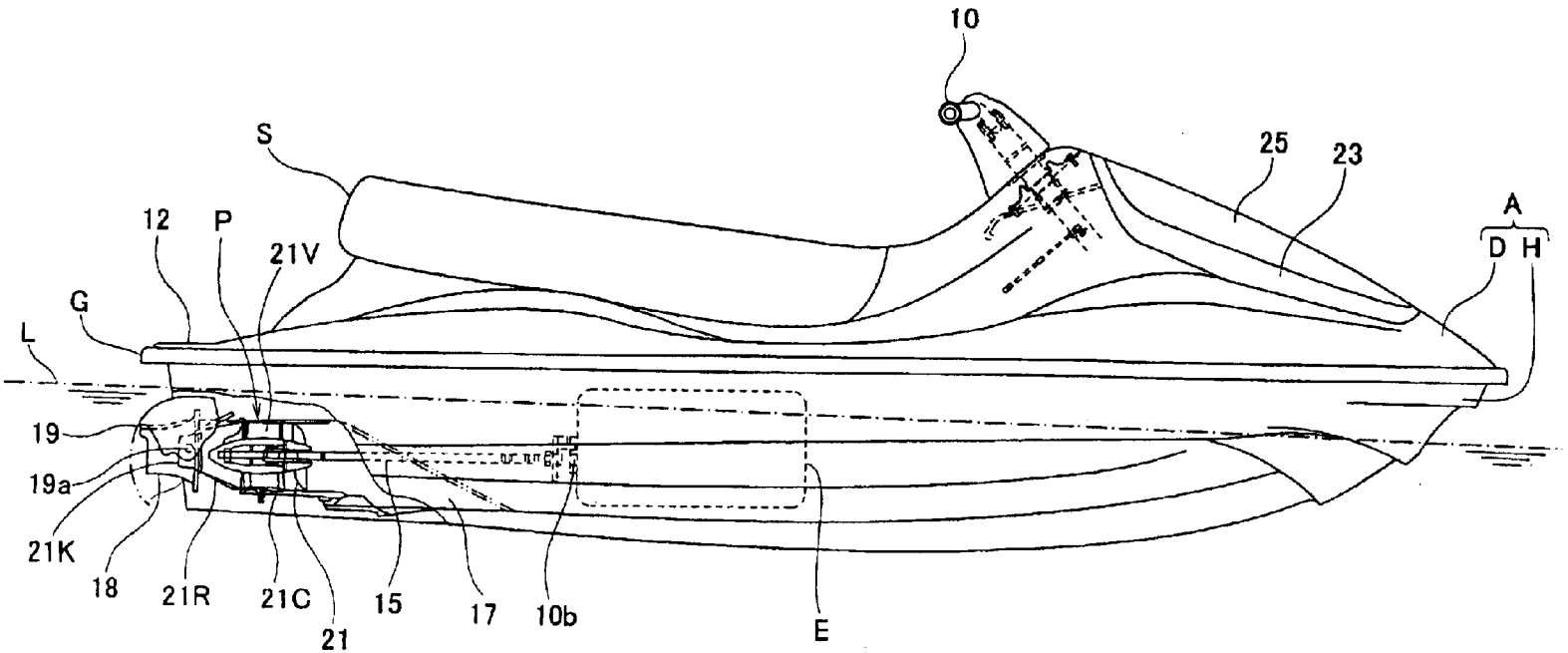
FIG. 1 is a side view showing an entire personal watercraft according to an embodiment of the present invention.
Figure 2:
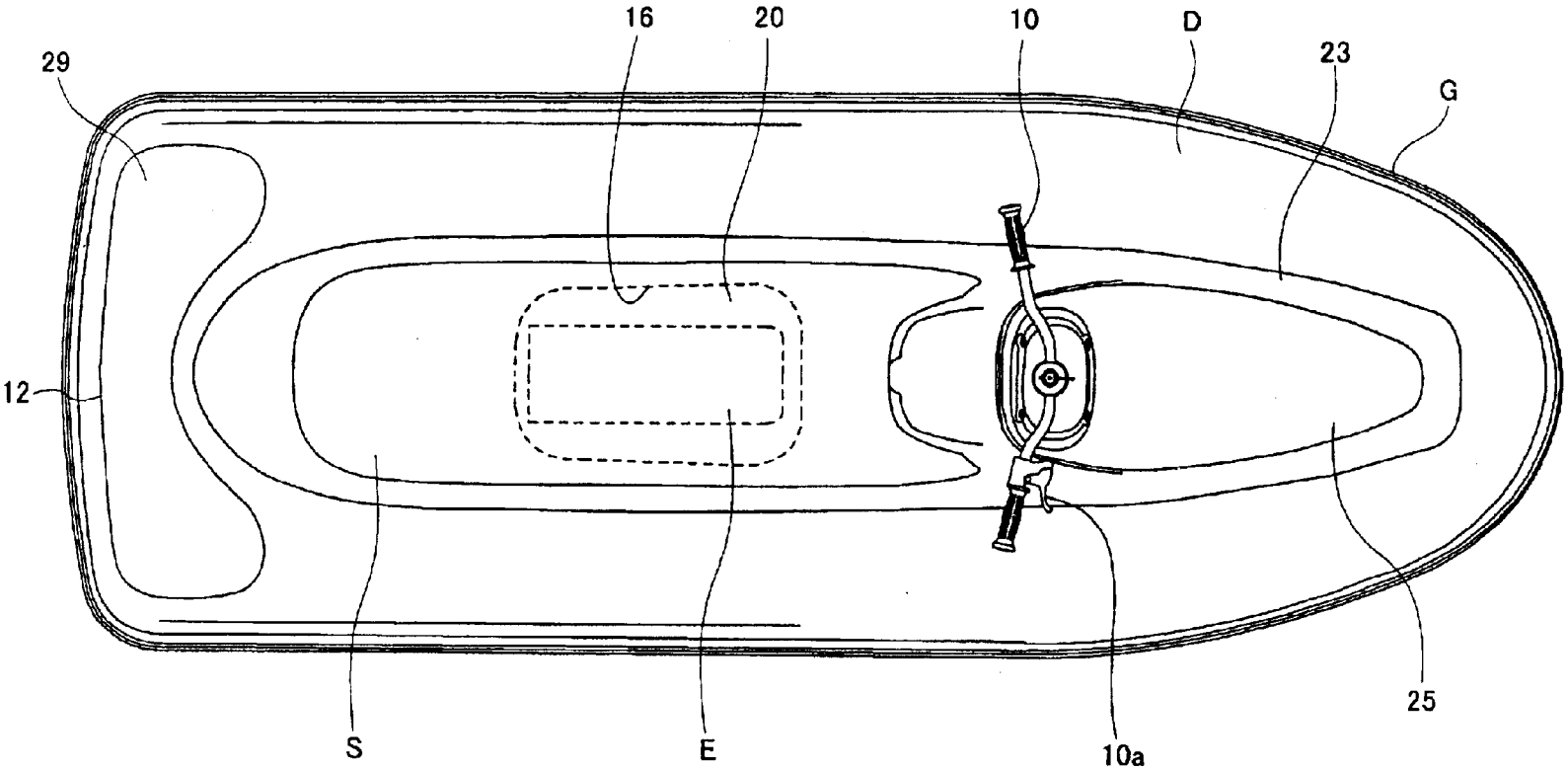
FIG. 2 is a plan view of the personal watercraft in FIG. 1.

FIG. 1 is a side view showing an entire personal watercraft according to an embodiment of the present invention and FIG. 2 is a plan view of the personal watercraft in FIG. 1. In FIGS. 1, 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided over the opening 16. An engine E is provided in a chamber (engine room) 20 surrounded by the hull H and the deck D below the seat S.

The engine E has multiple cylinders (e.g., three-cylinders). As shown in FIG. 1, a crankshaft of the engine E is mounted along the longitudinal direction of the body A. An output end 10*b* of the crankshaft is rotatably coupled integrally with a pump shaft of a water jet pump P through a propeller shaft 15. An impeller 21 is attached on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force. In FIG. 1, reference numeral 21V denotes fairing vanes for fairing water flow behind the impeller 21.

As shown in FIGS. 1, 2, reference numeral 10 denotes a bar-type steering handle. The handle 10 operates in association with a steering nozzle 18 swingable around a swing shaft (not shown) to the right or to the left behind the pump nozzle 21R. When the operator rotates the handle 10 clockwise or counterclockwise, the steering nozzle 18 is swung toward the opposite direction so that the watercraft can be correspondingly turned to any desired direction.

As shown in FIG. 1, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward, and as the resulting reaction, the personal watercraft moves rearward.

In FIGS. 1, 2, reference numeral 12 denotes a rear deck. The rear deck 12 is provided with an openable rear hatch cover 29. A rear compartment (not shown) with a small capacity is provided under the rear hatch cover 29. Reference numeral 23 denotes a front hatch cover. A front compartment (not shown) is provided under the front hatch cover 23 for storing equipment and the like. Another hatch cover 25 is provided over the front hatch cover 23, thereby forming a two-layer hatch cover. Life jackets or the like can be stored under the upper hatch cover 25 through an opening (not shown) provided in the rear end thereof.

Figure 3:
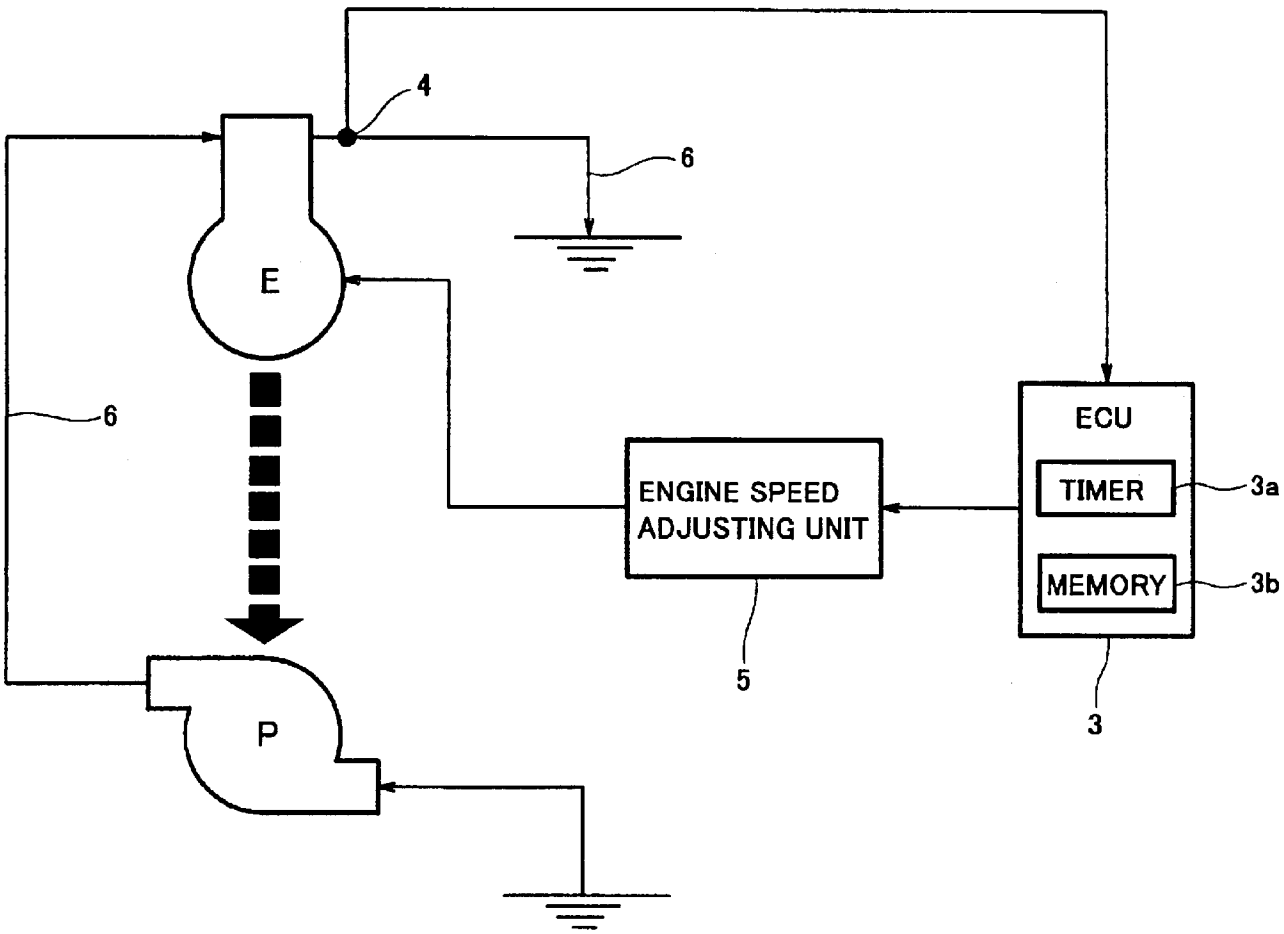
FIG. 3 is a block diagram showing a configuration of main components in a control system of the personal watercraft according to the embodiment of the present invention.

FIG. 3 is a block diagram showing a configuration of main components in an engine control system of the personal watercraft according to an embodiment of the present invention. As indicated by a broken-line arrow in FIG. 3, driven by the engine E, the water jet pump P takes in water from outside the watercraft through the water intake 17 (see FIG. 1) and ejects the water from the outlet 21K (see FIG. 1) through the pump nozzle 21R (see FIG. 1). The cooling water of the engine E is taken in into the engine E from a cooling water passage 6 connected at one end to a position of the water jet pump P (preferably, a position inside the water jet pump P and on the rear side of the impeller 21 (see FIG. 1), where static pressure is stable) and is discharged from the other end of the cooling water passage 6 outside the body A (see FIG. 1) through the engine E.

A temperature sensor 4 is attached to the cooling water passage 6 on an exit side from the engine E (for example, in the vicinity of the cylinder head), for detecting a temperature of the cooling water after cooling the engine E. The temperature sensor 4 is connected to an ECU (Electronic Control Unit) 3 and gives the detected temperature to the ECU 3. Instead, the temperature sensor 4 may be attached in a cooling water passage within engine cylinders of the engine E.

Based on the temperature given by the temperature sensor 4, the ECU 3 selects any one of a slow-mode control and a normal-mode control, and gives an instruction according to the selected control mode to an engine speed adjusting unit 5.

The engine speed adjusting unit 5 is comprised of, for example, a fuel injection unit, an ignition coil, an ignition plug, and the like of the engine E. The engine speed adjusting unit 5 adjusts the engine E so that the engine speed becomes an engine speed according to the control mode instructed by the ECU 3. The components of the engine speed adjusting unit 5 are not limited to the above-illustrated components and may be selectively utilized according to engine types such as carburetor type or fuel injection type. Also, the control means by which the engine speed adjusting unit 5 is controlled may be electrically or mechanically operational as long as it is able to limit the speed of the engine E. In the case of utilizing the mechanical type, for example, operatable range of a throttle lever 10*a* provided on the handle 10 (such as shown in FIG. 2) may be limited.

Figure 4:
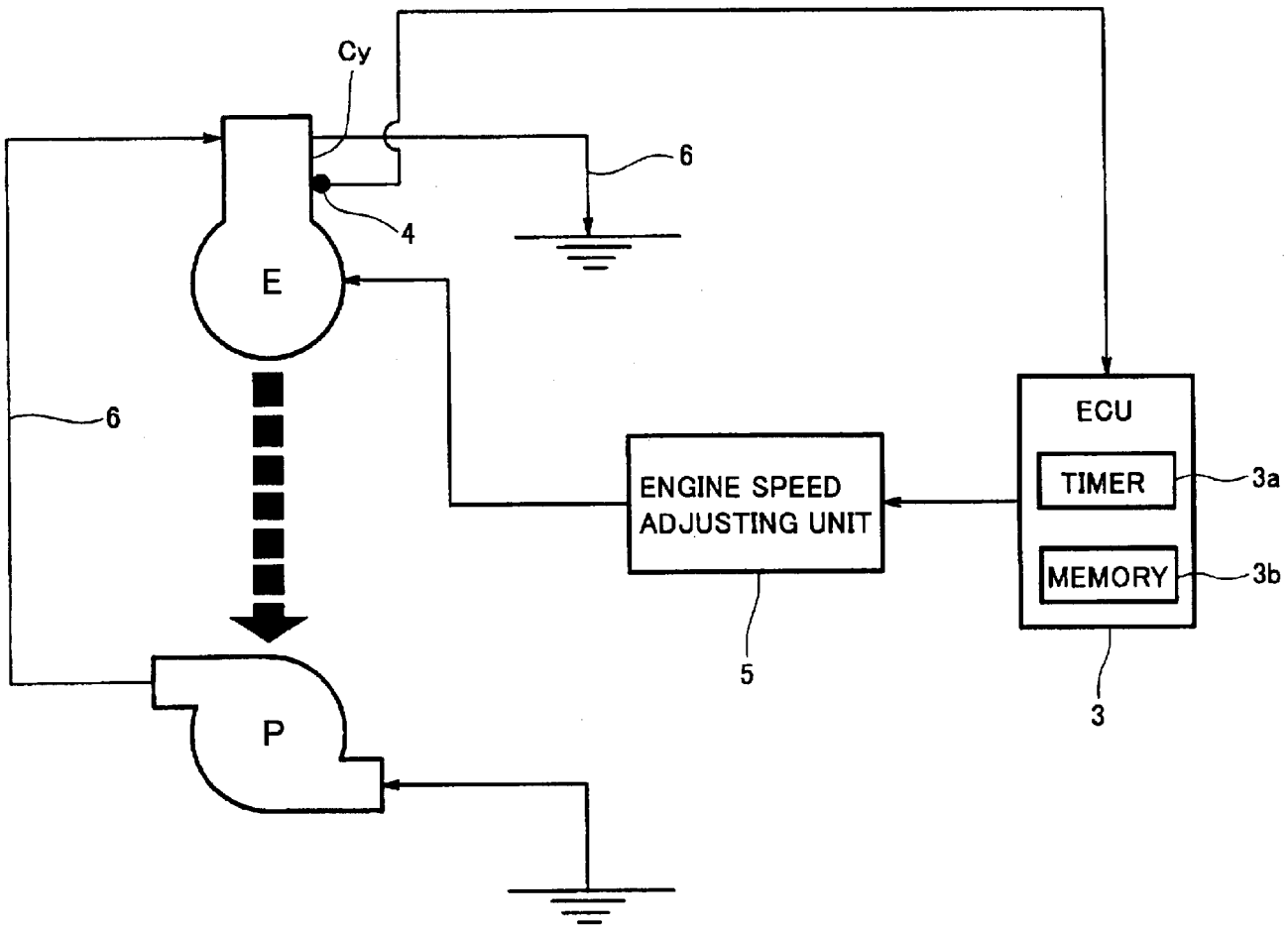
FIG. 4 is a block diagram showing a configuration of main components in a control system of a personal watercraft according to another embodiment of the present invention.

The temperature sensor 4 is attached to the cooling water passage 6 as described above. Alternatively, as shown in FIG. 4, the temperature sensor 4 may be attached to an outer surface of the engine cylinders Cy to measure the temperature of the engine cylinders. Further, as for the four-cycle engines, a temperature of lubricating oil (e.g., engine oil) may be measured as the temperature indicating a warmed-up state of the engine E.

Figure 5:
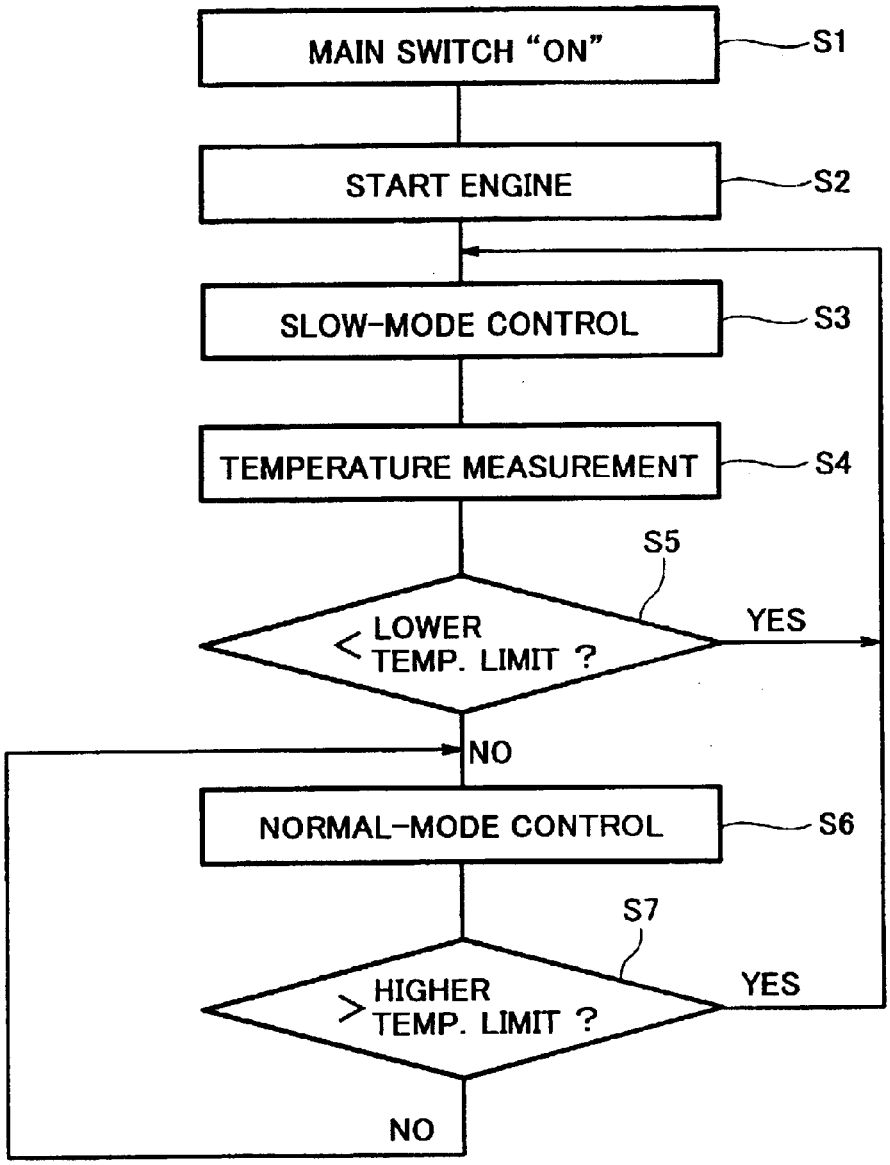
FIG. 5 is a flowchart showing a control procedure associated with warming up based on cooling water temperature and engine temperature.

In any one of the above configurations, as shown in FIG. 5, the ECU 3 is activated upon ON operation of a main switch (Step S1). Then, an engine starter motor (not shown) is energized, thereby starting the engine E (Step S2). At this time, the ECU 3 gives an instruction to the engine speed adjusting unit 5 so that the engine speed of the engine E does not exceed a predetermined engine speed (e.g., approximately 3000 rpm), thereby starting the slow-mode control (Step S3).

Then, the ECU 3 takes in the temperature detected by the temperature sensor 4 (cooling water temperature, cylinder temperature, or the like) (Step S4) and judges whether or not the detected temperature is lower than a predetermined lower limit value (Step S5). When the detected temperature is lower than the predetermined lower limit value (YES in Step S5), the ECU 3 judges that sufficient warming up is needed, and retunes the process to Step S3, thereby continuing the slow-mode control.

On the other hand, when the detected temperature is not lower than the predetermined lower limit value (NO in Step S5), the ECU 3 judges that sufficient warming up is completed and gives an instruction to the engine speed adjusting unit 5 to release the limitation of the engine speed of the engine E, thereby performing switching to the normal-mode control (Step S6).

Then, the ECU 3 judges whether or not the detected temperature is higher than a predetermined upper limit value (Step S7). When the detected temperature is higher than the predetermined upper limit value (YES in Step S7), the ECU 3 judges that the engine E is in an almost overheated state, and returns the process to Step S3, thereby performing switching to the slow-mode control for the purpose of facilitating cooling-down of the engine E.

On the other hand, when the detected temperature is not higher than the predetermined upper limit value (NO in Step S7), the ECU 3 retunes the process to Step S6 and thereby continues the normal-mode control.

Figure 6:
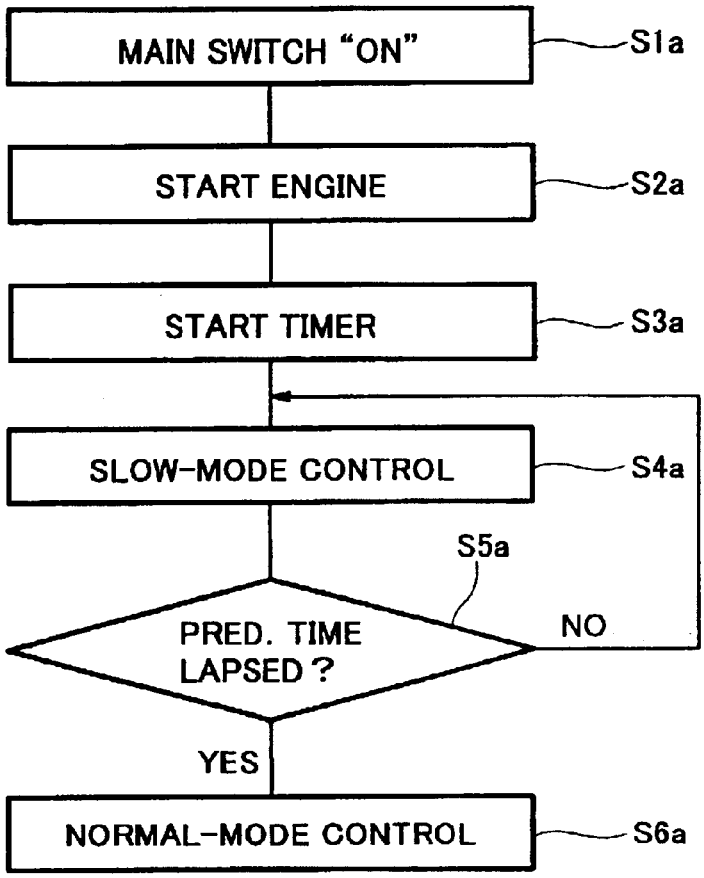
FIG. 6 is a flowchart showing a control procedure associated with warming up based on time from starting of an engine.

Instead of the control based on the measured temperature, as shown in FIG. 6, the slow-mode control may be executed for a predetermined time from starting of the engine E.

In this case, the ECU 3 first executes the process in Steps S1 and S2 (Steps S1*a* and S2*a*) and causes a built-in timer 3*a* to start clocking (see FIGS. 3 and 4) (Step S3*a*). Then, the ECU 3 gives an instruction to the engine speed adjusting unit 5 so that the engine speed does not exceed the predetermined engine speed (e.g., approximately 3000 rpm), thereby starting the slow-mode control (Step S4*a*).

Then, the ECU 3 judges whether or not the predetermined time has lapsed with reference to the timer 3*a* (Step S5*a*). When the predetermined time has lapsed (YES in Step S5*a*), the ECU 3 judges that sufficient warming up is completed, and gives an instruction to the engine speed adjusting unit 5 to release the limitation of the engine speed of the engine E, thereby performing switching to the normal-mode control (Step S6*a*). The predetermined time is pre-stored in a memory 3*b* contained in the ECU 3.

On the other hand, when the predetermined time has not lapsed (NO in Step S5*a*), the ECU 3 judges that sufficient warming up is not yet completed, and retunes the process to Step S4*a*, and thereby continues the slow-mode control. With the above configuration, it is configured such that the engine speed is limited to lower than the predetermined engine speed when the cooling water temperature, or the corresponding engine temperature or the corresponding time, is lower or less than respective predetermined value. However, it may also be configured so that the predetermined engine speed is gradually or stepwise increased corresponding to a degree of warming up (the cooling water temperature, the corresponding engine temperature or the corresponding time) of the engine E.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embodied by the claims.

What is claimed is:

1. A personal watercraft comprising:

a water jet pump for propelling the watercraft;

an engine for driving the water jet pump, wherein the engine includes an open-loop cooling system, the open-loop cooling system having a cooling water passage of open-loop cooling type using water taken in from outside the watercraft as cooling water; and a control unit for limiting an engine speed of the engine to be lower than a predetermined engine speed when a temperature of the cooling water of the engine is lower than a first predetermined temperature.

2. The personal watercraft according to claim 1, further comprising:

a temperature detecting means for detecting the temperature of the cooling water, wherein the control unit is adapted to limit the engine speed to be lower than the predetermined engine speed when the temperature of the cooling water detected by the temperature detecting means is lower than the first predetermined temperature.

3. The personal watercraft according to claim 2, wherein the temperature detecting means is provided to the cooling water passage.

4. The personal watercraft according to claim 3, wherein the temperature detecting means is provided on an exit of the cooling water from the engine.

5. The personal watercraft according to claim 2 wherein the temperature detecting means is provided on an outer surface of a cylinder of the engine.

6. The personal watercraft according to claim 1, further comprising:

a temperature detecting means for detecting a temperature of the engine, wherein the control unit is adapted to limit the engine speed to be lower than the predetermined engine speed when the temperature of the engine detected by the temperature detecting means is almost equal to a temperature which corresponds to the temperature of the cooling water being lower than the first predetermined temperature.

7. The personal watercraft according to claim 1, wherein the control unit is adapted to limit the engine speed to be lower than the predetermined engine speed for a time which corresponds to a time from when the engine starts until the temperature of the cooling water reaches the first predetermined temperature.

8. The personal watercraft according to claim 7, wherein the control unit includes:

a timer; and a memory for storing the time from when the engine starts until the temperature of the cooling water reaches the first predetermined temperature, and wherein the control unit is adapted to cause the timer to start clocking in response to start of the engine, and then to judge whether or not the time clocked by the timer has lapsed with the time stored in the memory, and wherein the control unit is adapted to limit the engine speed to be lower than the predetermined engine speed while judging that the time stored in the memory has not lapsed.

9. The personal watercraft according to claim 1, wherein the open-loop cooling system is adapted to use water supplied from the water jet pump as the cooling water.

10. The personal watercraft according to claim 1, wherein the predetermined engine speed is approximately 3000 rpm.

11. The personal watercraft according to claim 1, wherein the engine speed is an idling speed.

12. The personal watercraft according to claim 1, wherein the control unit is adapted to limit the engine speed by adjusting a fuel injection amount of the engine.

13. The personal watercraft according to claim 1, wherein the control unit is adapted to limit the engine speed by adjusting a fuel injection timing of the engine.

14. The personal watercraft according to claim 1, wherein the control unit is adapted to limit the engine speed by adjusting an ignition timing of the engine.

15. The personal watercraft according to claim 1, wherein the control unit is adapted to limit the engine speed by adjusting a throttle of the engine.

16. The personal watercraft according to claim 1, wherein the control unit is adapted to gradually increase the predetermined engine speed according to an increase in the temperature of the cooling water during progress of warming up of the engine.

17. The personal watercraft according to claim 1, wherein the control unit is adapted to limit the engine speed to be lower than the predetermined engine speed when the temperature of the cooling water is higher than a second predetermined temperature which is higher than the first predetermined temperature.

* * * * *